US011352990B2

(12) United States Patent
Ehara

(10) Patent No.: US 11,352,990 B2
(45) Date of Patent: Jun. 7, 2022

(54) FUEL SUPPLY DEVICE OF ENGINE

(71) Applicant: MIKUNI CORPORATION, Tokyo (JP)

(72) Inventor: Ryouji Ehara, Odawara (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 17/409,117

(22) Filed: Aug. 23, 2021

(65) Prior Publication Data

US 2022/0065204 A1 Mar. 3, 2022

(30) Foreign Application Priority Data

Aug. 31, 2020 (JP) ..... JP2020-145832

(51) Int. Cl.
*F02M 37/10* (2006.01)
*F02M 37/18* (2006.01)
*F02M 37/02* (2006.01)

(52) U.S. Cl.
CPC ..... *F02M 37/106* (2013.01); *F02M 37/025* (2013.01); *F02M 37/18* (2013.01); *F02M 2700/137* (2013.01)

(58) Field of Classification Search
CPC ..... F02M 2700/137; F02M 37/18; F02M 37/025; F02M 37/106
See application file for complete search history.

(56) References Cited

U.S. PATENT DOCUMENTS 6,694,955 B1 * 2/2004 Griffiths ..... F02M 25/089 123/509
2002/0185115 A1 * 12/2002 Capshaw ..... F02M 37/20 123/518
2014/0202420 A1 * 7/2014 Jaasma ..... F02M 37/0064 123/304

FOREIGN PATENT DOCUMENTS

JP 2016-37939 3/2016

* cited by examiner

*Primary Examiner* — Kevin A Lathers

(57) ABSTRACT

A fuel supply device of an engine includes a primary pump suctioning fuel to discharge the fuel to a first pipeline, a secondary pump connected in series to the primary pump via the first pipeline, and suctioning the fuel from the primary pump to supply the fuel through a second pipeline to an engine side, a tank storing the fuel and accommodating the secondary pump, an outflow part causing part of the fuel flowing from the first pipeline through the secondary pump to the second pipeline in the tank to flow outward, a third pipeline returning, to a suction side of the primary pump, gas-liquid mixed fuel generated by vaporizing the fuel flowing out from the outflow part, and a preloading part in one of portions of a circulation path formed between the primary pump and the tank by the first pipeline and the third pipeline and preloading the fuel.

7 Claims, 3 Drawing Sheets

FUEL SUPPLY DEVICE OF ENGINE

CROSS REFERENCE TO RELATED APPLICATIONS

This application is based upon and claims the benefit of priority of the prior Japanese Patent Application No. 2020-145832, filed on Aug. 31, 2020, the entire contents of which are incorporated herein by reference.

BACKGROUND OF THE INVENTION

Field of the Invention

The present invention relates to a fuel supply device of an engine.

Description of the Related Art

For example, a fuel supply device of an engine described in Japanese Patent Laid-Open No. 2016-37939 (hereinafter, referred to as Patent Literature 1) supplies fuel stored in a main fuel tank to a fuel injection valve of each cylinder of the engine via a sealed type of sub fuel tank. The main fuel tank is connected to the sub fuel tank via a fuel pipeline. The fuel in the sub fuel tank is suctioned up by a fuel pump and supplied to an engine side, and the fuel in the main fuel tank is drawn to the sub fuel tank by use of negative pressure generated in the sub fuel tank at this time. In the sub fuel tank, the fuel is vaporized to generate gas fuel. Consequently, the gas fuel is mixed with liquid fuel suctioned up from interior of the sub fuel tank, to process this gas fuel, and this gas-liquid mixed fuel is boosted and liquefied in the fuel pump and supplied to the engine side.

Thus, the fuel supply device of Patent Literature 1 includes a single fuel pump, but may include a fuel pump for exclusive use in supplying the fuel from the main fuel tank to the sub fuel tank. For example, FIG. 3 shows a fuel supply device 102 for a ship 101. The fuel supply device 102 is mounted together with an engine 104 in an outboard machine 103 coupled to a rear part of the ship 101. A suction side of a primary pump 105 of the fuel supply device 102 is connected to a main fuel tank 108 on a ship 101 side via a hose 106 and a supply pipeline 107. A discharge side of the primary pump 105 is connected to a sealed type of sub fuel tank 111 via a check valve 109 and a low pressure pipeline 110, and the fuel discharged from the primary pump 105 has its pressure adjusted by a relief valve 121, and is supplied through the low pressure pipeline 110 to the sub fuel tank 111.

A secondary pump 112 is accommodated in the sub fuel tank 111, and one end of a suction pipeline 113 is connected to a suction side of the pump. The other end of the suction pipeline 113 is opened in a lower part of the sub fuel tank 111, and an intermediate portion of the suction pipeline 113 is opened in an upper part of the sub fuel tank 111 via a pair of orifices 114. A high pressure pipeline 116 is connected to a discharge side of the secondary pump 112 via a check valve 115, and the high pressure pipeline 116 extends outward from interior of the sub fuel tank 111, and is connected to fuel injection valves 118 of respective cylinders of the engine 104 via a delivery pipe 117. A cooling pipe 119 is disposed in the sub fuel tank 111, and seawater or the like of the sea where the ship 101 sails is circulated in the pipe. The fuel from the primary pump 105 is stored in the sub fuel tank 111, and the secondary pump 112 heated with an operation is cooled by the cooling pipe 119 by use of the fuel as a medium.

Part of the fuel is vaporized during the cooling of the secondary pump 112, and stays as the gas fuel in the upper part of the sub fuel tank 111. By the operation of the secondary pump 112, the liquid fuel stored in the lower part of the sub fuel tank 111 is suctioned up into the suction pipeline 113. In this case, the gas fuel in the upper part of the tank 111 is mixed with the liquid fuel in the suction pipeline 113 via the orifices 114, and is suctioned as the gas-liquid mixed fuel into the secondary pump 112. The gas-liquid mixed fuel is boosted and liquefied in the secondary pump 112, and guided through the high pressure pipeline 116 toward the engine 104 for use in combustion inside each cylinder.

However, the fuel supply device 102 of the engine 104 shown in FIG. 3 might be in an unstable state in terms of controllability of discharge pressure from the secondary pump 112, that is, fuel pressure controllability, depending on usage environment.

A main factor for the state lies in that a gas-liquid mixture ratio representing a ratio between the gas fuel and the liquid fuel that are contained in the fuel supplied to the secondary pump 112 might fluctuate. Such fluctuation phenomenon is caused by variation in amount of the gas fuel generated in the sub fuel tank 111, variation in gas-liquid mixture ratio of the fuel suctioned into the suction pipeline 113, or the like.

For example, the vaporization of the liquid fuel in the sub fuel tank 111 proceeds as volatility in properties of the fuel increases, and the vaporization proceeds with an elapsed time from engine stop. Furthermore, the vaporization proceeds as an in-tank temperature rises, and the vaporization proceeds as the liquid fuel in the tank is stirred more intensely by vibration. Therefore, due to these environmental disturbances, the variation occurs in amount of the gas fuel generated in the sub fuel tank 111.

Additionally, since the fuel is stirred in the sub fuel tank 111 by the vibration, not only the gas fuel but also the liquid fuel is suctioned into the suction pipeline 113 via the orifices 114 in the upper part of the tank. Then, the variation occurs in gas-liquid mixture ratio of the fuel suctioned through the orifices 114, in accordance with a stirred state of the fuel in the tank. Consequently, variation also occurs in entire gas-liquid mixture ratio of the fuel combined with the liquid fuel suctioned from the tank lower part into the suction pipeline 113.

As a result, the gas-liquid mixture ratio of the fuel supplied to the secondary pump 112 fluctuates, and a liquefied state of the gas fuel when boosted in the secondary pump 112 also fluctuates. That is, the fuel with any gas-liquid mixture ratio is certainly liquefied by the boosting in the secondary pump 112, but the fuel containing more gas fuel has its volume reduced more after liquefied. Therefore, an amount of the fuel discharged from the secondary pump 112 tends to decrease. For example, a discharge pressure of the secondary pump 112 is detected by a pressure sensor 120 shown in FIG. 3, and the secondary pump 112 is subjected to duty control to keep the discharge pressure at a preset target value. However, transient control delay is unavoidable. This becomes a factor to collapse correlation between a valve opening time and an injection amount of the fuel injection valve 118, and causes a problem that appropriate fuel injection control cannot be eventually achieved and that engine performance might drop.

SUMMARY OF THE INVENTION

The present invention has been developed to solve such a problem, and an object thereof is to provide a fuel supply device of an engine, in which fluctuation of a gas-liquid mixture ratio of fuel to be supplied to a secondary pump can be suppressed to improve fuel pressure controllability, and thereby, appropriate fuel injection control can be achieved to improve engine performance.

To achieve the above object, a fuel supply device of an engine of the present invention includes a primary pump suctioning fuel supplied from a fuel supply source to discharge the fuel to a first pipeline, a secondary pump connected in series to the primary pump via the first pipeline, and suctioning the fuel supplied from the primary pump through the first pipeline to supply the fuel through a second pipeline to an engine side, a tank storing the fuel, and accommodating the secondary pump inside, an outflow part causing part of the fuel flowing from the first pipeline through the secondary pump to the second pipeline in the tank to flow out into the tank, a third pipeline connecting an interior of the tank and a suction side of the primary pump, and returning, to the suction side of the primary pump, gas-liquid mixed fuel generated in the tank by vaporizing the fuel flowing out from the outflow part, and a preloading part provided in one of portions of a circulation path formed between the primary pump and the tank by the first pipeline and the third pipeline, and preloading the fuel circulating through the circulation path.

As another aspect, the preloading part may be a pressure adjustment valve provided in the third pipeline.

As still another aspect, the preloading part may be a pressure adjustment valve interposed in a fourth pipeline connecting the first pipeline and the third pipeline.

As a further aspect, the outflow part may be an orifice provided in the first pipeline in the tank, and causing part of the fuel flowing through the first pipeline to flow out into the tank while restricting the part of the fuel.

As a further aspect, the outflow part may be a pressure adjustment valve connected to the second pipeline in the tank, opening and closing based on a set pressure to adjust a discharge pressure of the secondary pump, and causing the fuel discharged from the secondary pump when the valve is opened to flow out into the tank.

As a still further aspect, the third pipeline may connect an upper part of the interior of the tank and the suction side of the primary pump.

According to the fuel supply device of the engine of the present invention, fluctuation of a gas-liquid mixture ratio of the fuel to be supplied to the secondary pump can be suppressed to improve fuel pressure controllability, and consequently, appropriate fuel injection control can be achieved to improve engine performance.

DETAILED DESCRIPTION OF THE INVENTION

First Embodiment

Figure 1:
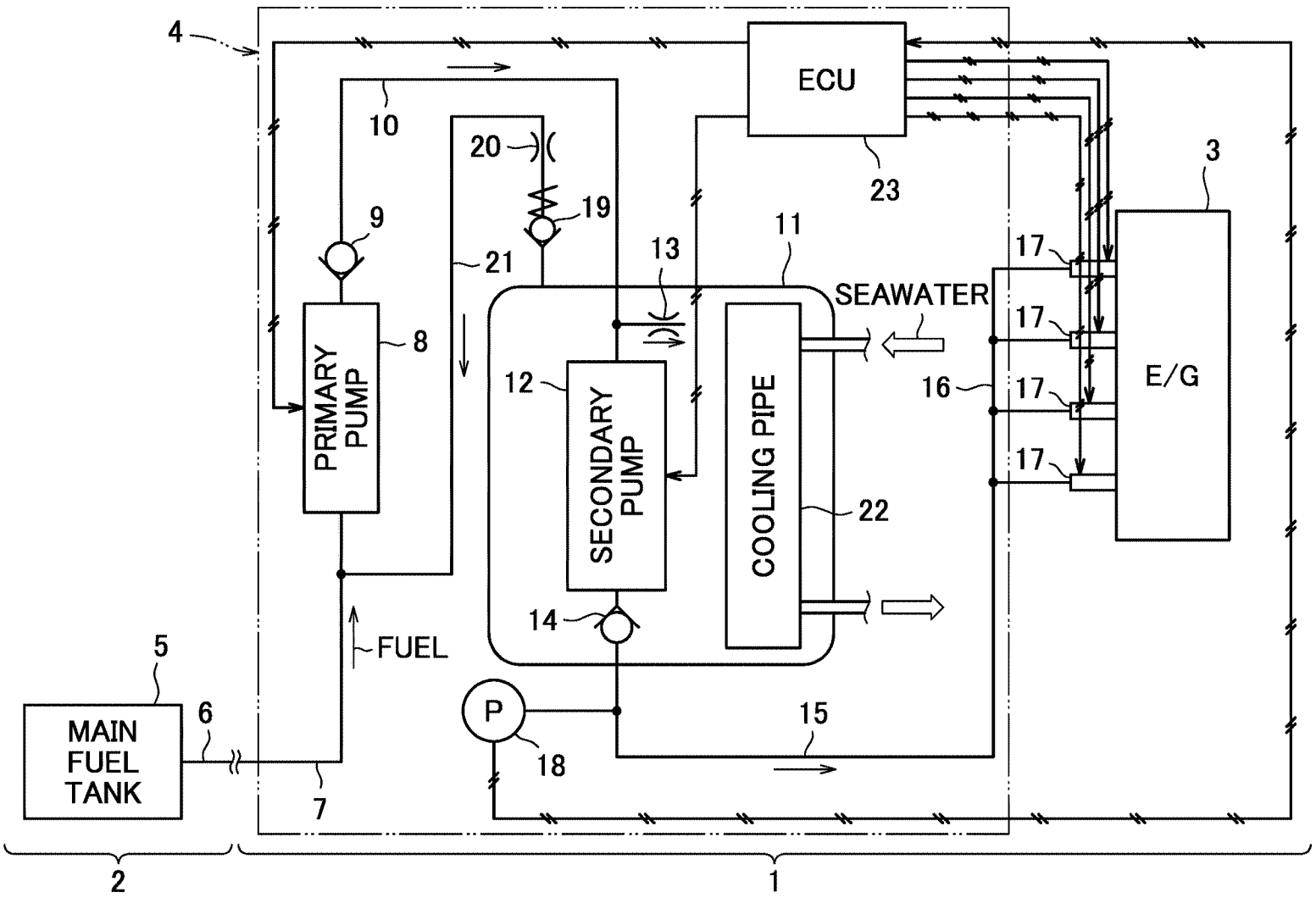
FIG. 1 is a system configuration diagram showing a fuel supply device of an engine of a first embodiment.

Hereinafter, description will be made as to a first embodiment of the present invention embodied in a fuel supply device of an engine to be mounted in an outboard machine of a ship with reference to FIG. 1.

An outboard machine 1 is coupled to a rear part of a ship 2, and a fuel supply device 4 is mounted together with an engine 3 as a power source. A main fuel tank 5 corresponding to a fuel supply source of the present invention is mounted in the ship 2, and a pipeline having flexibility, for example, a hose 6 is connected to the main fuel tank 5 and extends into the outboard machine 1. In the outboard machine 1, the hose 6 is connected to a suction side of a primary pump 8 via a supply pipeline 7, and a discharge side of the primary pump 8 extends into a sealed type of sub fuel tank 11 via a check valve 9 and a low pressure pipeline 10. The check valve 9 allows fuel to flow from the primary pump 8 to the sub fuel tank 11, and blocks the flow in a reverse direction.

A secondary pump 12 is accommodated in the sub fuel tank 11, and the pump on the suction side is connected to a low pressure pipeline 10, and as a result, the primary pump 8 is connected in series to the secondary pump 12 via the low pressure pipeline 10. The low pressure pipeline 10 branches in a vicinity of the suction side of the secondary pump 12, and is opened into the sub fuel tank 11 via an orifice 13. A high pressure pipeline 15 is connected to the suction side of the secondary pump 12 via a check valve 14, and the high pressure pipeline 15 extends outward from an interior of the sub fuel tank 11, and is connected to fuel injection valves 17 of respective cylinders of the engine 3 via a delivery pipe 16. The check valve 14 allows the fuel to flow from the secondary pump 12 toward the engine 3, and blocks the flow in a reverse direction. A pressure sensor 18 is connected to the high pressure pipeline 15, and a discharge pressure of the secondary pump 12 is detected by the sensor 18.

In the present embodiment, the low pressure pipeline 10 corresponds to a first pipeline of the present invention, the high pressure pipeline 15 corresponds to a second pipeline of the present invention, and the orifice 13 corresponds to an outflow part of the present invention.

One end of a return pipeline 21 is connected to an upper part of the sub fuel tank 11 via a relief valve 19 and an orifice 20, and the other end of the return pipeline 21 is connected to the supply pipeline 7, that is, the suction side of the primary pump 8. The relief valve 19 is formed as a normally closed type, closes when a pressure in the sub fuel tank 11 is lower than a set pressure of the valve, and opens when the pressure in the sub fuel tank 11 is in excess of the set pressure. A cooling pipe 22 is disposed in the sub fuel tank 11, and seawater and the like of the sea where the ship 2 coupled to the outboard machine 1 sails circulate in the pipe. The fuel from the primary pump 8 is stored in the sub fuel tank 11, and the secondary pump 12 heated with an operation is cooled by the fuel. Furthermore, the fuel having a temperature raised is cooled by heat exchange between the fuel and the cooling pipe 22, so that the secondary pump 12 is prevented from being overheated.

In the present embodiment, the relief valve 19 corresponds to a preloading part or a pressure adjustment valve of the present invention, and the return pipeline 21 corresponds to a third pipeline of the present invention.

The fuel supply device 4 and the engine 3 are controlled by an electronic control unit (ECU) 23 mounted in the outboard machine 1. The ECU 23 includes an input/output unit, a storage unit (ROM, RAM or the like) for use in storing control program, control map or the like, a central processing unit (CPU), a timer counter and the like that are not shown in the drawing. Sensors to detect information required for engine control, for example, an engine rotation speed sensor and an intake negative pressure sensor that are not shown in the drawing are connected to an input side of the ECU 23, and the pressure sensor 18 of the fuel supply device 4 is also connected. Devices to operate the engine 3, for example, the fuel injection valves 17 and an unshown ignition device are connected to an output side of the ECU 23, and the primary pump 8 and the secondary pump 12 of the fuel supply device 4 are also connected.

The ECU 23 supplies power from an unshown battery to the primary pump 8 and the secondary pump 12 to operate the pumps, and consequently, the fuel from the main fuel tank 5 is supplied through the fuel supply device 4 to the respective fuel injection valves 17 of the engine 3. A target value of the discharge pressure of the secondary pump 12, for example, 300 kPa is set in advance, and the ECU 23 executes duty control of the secondary pump 12 to keep the discharge pressure at this target value. In parallel with such control of the fuel supply device 4, the ECU 23 drives and controls the fuel injection valves 17 and the ignition device based on detection information from the sensors to operate the engine 3. Although not shown in the drawing, driving force of the engine 3 is transmitted to a screw of the outboard machine 1 to rotate the screw, and thus, a propulsive force to navigate the ship 2 is generated.

During the operation of the engine 3 described above, in the fuel supply device 4 of the present embodiment, liquefying of gas fuel contained in the fuel is facilitated, and fluctuation of the gas-liquid mixture ratio is suppressed with the facilitation of the liquefying. Consequently, satisfactory fuel pressure controllability can be achieved. Hereinafter, this will be described in detail.

The fuel from the main fuel tank 5 on a ship 2 side is suctioned through the supply pipeline 7 into the primary pump 8, discharged from the primary pump 8 through the low pressure pipeline 10 and suctioned into the secondary pump 12. Furthermore, the fuel is discharged from the secondary pump 12, supplied through the high pressure pipeline 15 to the respective fuel injection valves 17 of the engine 3, and injected at predetermined timing for use in combustion inside the respective cylinders. Part of the fuel discharged from the primary pump 8 and flowing through the low pressure pipeline 10 is not suctioned into the secondary pump 12, flows as surplus fuel through the orifice 13 into the sub fuel tank 11 and is stored. The outflow of the fuel at this time is moderately restricted by the orifice 13, and hence, the fuel to be supplied to the secondary pump 12 is kept at an expected fuel pressure.

On the other hand, as described above, in the sub fuel tank 11, the secondary pump 12 is cooled by the cooling pipe 22 by use of the fuel as a medium, and part of the fuel in contact with the secondary pump 12 is vaporized to generate the gas fuel. The discharge pressure of the primary pump 8 acts in the sub fuel tank 11, and additionally, the gas fuel is generated. Therefore, when the relief valve 19 is closed, the pressure in the sub fuel tank 11 gradually rises. Then, if the relief valve 19 is in excess of the set pressure to open, gas-liquid mixed fuel generated in the sub fuel tank 11 is guided to a return pipeline 21 side.

As a result, the interior of the sub fuel tank 11 is always preloaded at the set pressure of the relief valve 19, for example, about 120 kPa. The liquefying of the fuel is facilitated under this pressure, and hence, most of the gas fuel contained in the sub fuel tank 11 is liquefied. Furthermore, the gas-liquid mixture ratio of the fuel is kept almost constant due to increase in ratio of liquid fuel.

Note that as will be described later, the gas-liquid mixed fuel flowing through the relief valve 19 is returned through the return pipeline 21 to the suction side of the primary pump 8, and an amount of the fuel to be returned to the return pipeline 21 in this case is moderately restricted by the orifice 20. However, the orifice 20 does not necessarily have to be provided, and may be omitted.

Figure 3:
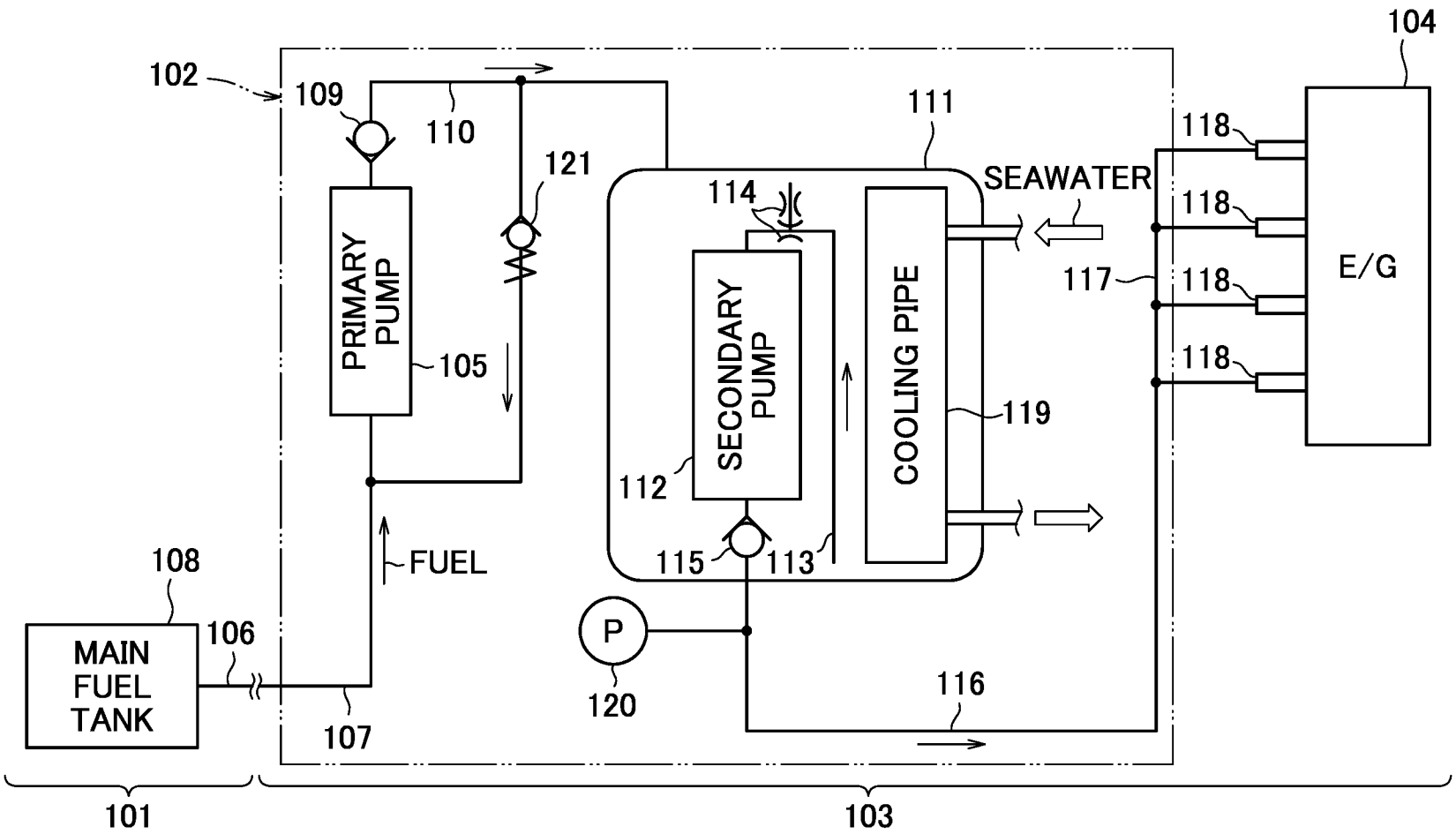
FIG. 3 is a system configuration diagram showing a conventional fuel supply device of an engine.

In a conventional art shown in FIG. 3, variation occurs in amount of gas fuel generated in a sub fuel tank 111, for example, due to environmental disturbances such as fuel properties, an engine stop time, an in-tank temperature, and stirring the liquid fuel in the tank, and this phenomenon is one of factors that fluctuate the gas-liquid mixture ratio of the fuel to be supplied to a secondary pump 112. Impact of such environmental disturbances is reduced in the present embodiment, and the sub fuel tank 11 is preloaded to suppress the fluctuation of the gas-liquid mixture ratio. Additionally, most of the fuel is the liquid fuel.

On the other hand, the gas-liquid mixed fuel flowing through the opened relief valve 19 is returned through the return pipeline 21 to the suction side of the primary pump 8, and suctioned again through the low pressure pipeline 10 into the secondary pump 12. Furthermore, part of the fuel flows out as the surplus fuel through the orifice 13 into the sub fuel tank 11. As a result, a circulation path is formed between the primary pump 8 and the sub fuel tank 11 by the low pressure pipeline 10 and the return pipeline 21, and the fuel circulating through this circulation path is sequentially suctioned in accordance with the operation of the secondary pump 12.

In the conventional art shown in FIG. 3, the fuel in the sub fuel tank 111 is stirred by vibration, and variation occurs in gas-liquid mixture ratio of the fuel suctioned into a suction pipeline 113. This phenomenon is one of factors that fluctuate the gas-liquid mixture ratio of the fuel to be supplied to the secondary pump 112. On the contrary, in the present embodiment, the fuel in the sub fuel tank 11 is not directly supplied to the secondary pump 12. The fuel circulating through the circulation path, that is, the fuel preloaded in the sub fuel tank 11 to have a high ratio of the liquid fuel and kept at an almost constant gas-liquid mixture ratio is continuously supplied to the secondary pump 12.

The gas-liquid mixture ratio of the fuel to be supplied to the secondary pump 12 is kept almost constant in this manner, and hence, fluctuation of a liquefied state of the gas fuel when boosted in the secondary pump 12 is suppressed. Fluctuation of a volume of the liquefied fuel is also suppressed. Consequently, the discharge pressure of the secondary pump 12, that is, the pressure of the fuel to be supplied to an engine 3 side is stabilized, and hence, the fuel pressure controllability can improve. Thus, appropriate fuel injection control can be achieved on the engine 3 side, and hence, engine performance can improve.

Additionally, since the ratio of the liquid fuel in the fuel to be supplied to the secondary pump 12 is high, an amount of the gas fuel required to be liquefied by the boosting in the secondary pump 12 is very small. Consequently, the secondary pump 12 operates with low load and constant load, and power consumption decreases with improvement of pump efficiency. Therefore, another advantage that power generation load is reduced to improve fuel efficiency can be obtained.

Second Embodiment

Figure 2:
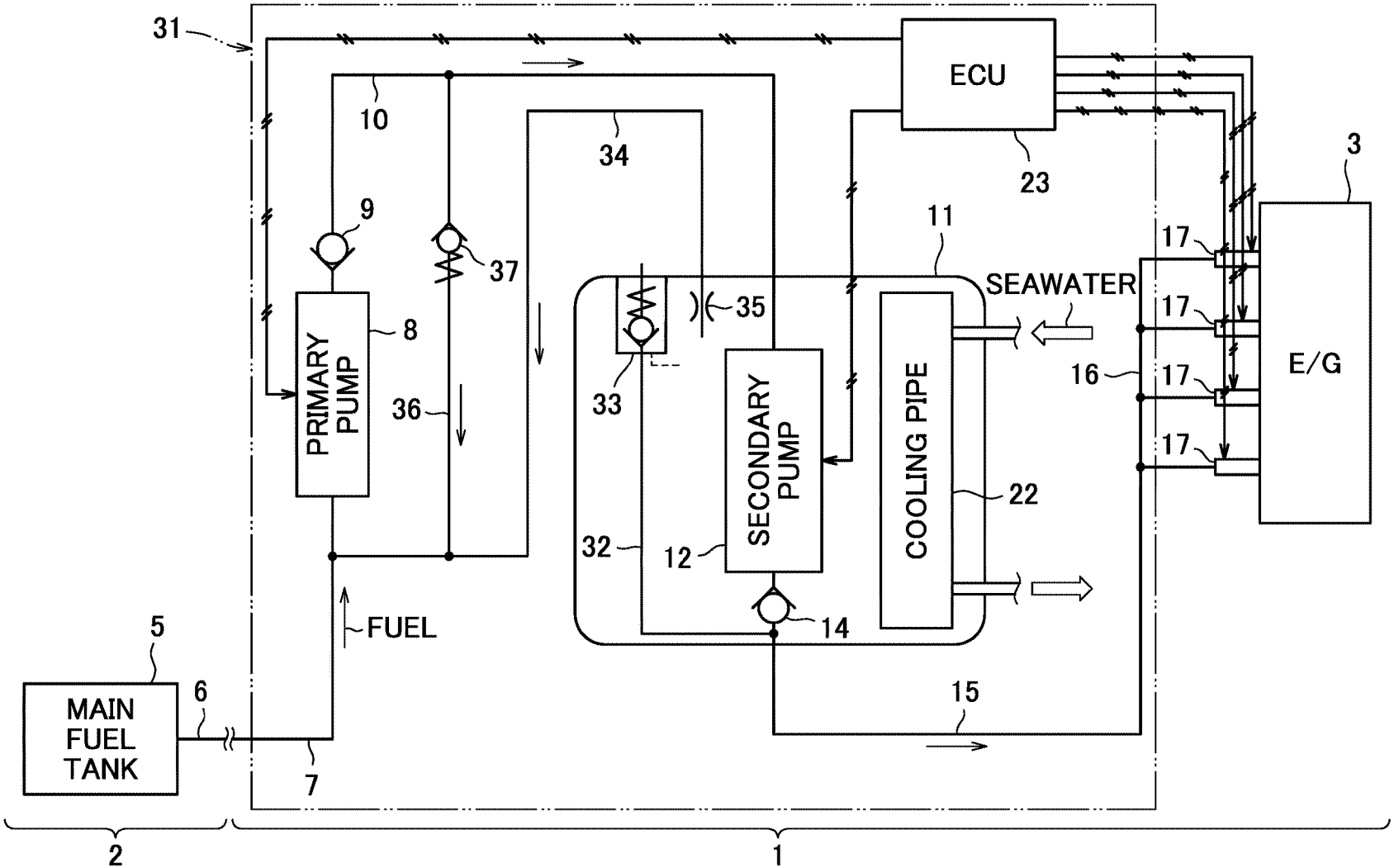
FIG. 2 is a system configuration diagram showing a fuel supply device of an engine of a second embodiment.

Next, a second embodiment of the present invention embodied in a fuel supply device of another engine 3 will be described with reference to FIG. 2. The present embodiment is different from the first embodiment in a fuel supply device 31, particularly in that a low pressure pipeline 10 is preloaded in the present embodiment instead of preloading a sub fuel tank 11, and in that a regulator valve 33 is used in the present embodiment instead of duty control of a secondary pump 12. Therefore, a common part is denoted with the same member numbers and omitted from description, and differences will be mainly described.

A hose 6 from a main fuel tank 5 is connected to a suction side of a primary pump 8 via a supply pipeline 7 in an outboard machine 1, and a discharge side of the primary pump 8 is connected to a suction side of the secondary pump 12 accommodated in the sub fuel tank 11, via a check valve 9 and the low pressure pipeline 10. In the sub fuel tank 11, the regulator valve 33 is connected to a discharge side of the secondary pump 12 via a regulator pipeline 32.

The regulator valve 33 is formed as a normally closed type, closes when a discharge pressure of the secondary pump 12 acting through the regulator pipeline 32 is lower than a set pressure of the valve, and opens when the discharge pressure of the secondary pump 12 is in excess of the set pressure. The regulator valve 33 is controlled in accordance with intake pipe pressure, or differential pressure from atmospheric pressure. Even if pressure fluctuation occurs in the tank 11, the discharge pressure of the secondary pump 12 is kept at the set pressure of the regulator valve 33, for example, about 300 kPa. In the present embodiment, the regulator valve 33 corresponds to an outflow part or a pressure adjustment valve of the present invention.

One end of a return pipeline 34 is inserted into an upper part of the sub fuel tank 11, and opened in the sub fuel tank 11 via an orifice 35, and the other end of the return pipeline 34 is connected to the suction side of the primary pump 8. The low pressure pipeline 10 is connected to the return pipeline 34 via a relief pipeline 36, and a relief valve 37 is interposed in the relief pipeline 36. The relief valve 37 is formed as a normally closed type, closes when a pressure in the low pressure pipeline 10 is lower than a set pressure of the valve, and opens when the pressure in the low pressure pipeline 10 is in excess of the set pressure. As a result, the pressure in the low pressure pipeline 10 is adjusted to the set pressure of the relief valve 37, for example, about 120 kPa. In the present embodiment, the relief pipeline 36 corresponds to a fourth pipeline of the present invention, and the relief valve 37 corresponds to a preloading part or a pressure adjustment valve of the present invention.

Next, an operation state of the fuel supply device 31 during an operation of the engine 3 will be described.

Fuel from the main fuel tank 5 is discharged from the primary pump 8, suctioned through the low pressure pipeline 10 into the secondary pump 12 and discharged through a high pressure pipeline 15 to an engine 3 side. The regulator valve 33 opens and closes based on the set pressure to adjust the discharge pressure of the secondary pump 12. When the valve opens, the fuel discharged from the secondary pump 12 flows out into the sub fuel tank 11, and is decompressed, boiled and vaporized in the sub fuel tank 11. Furthermore, similarly to the first embodiment, when cooling the secondary pump 12, part of the fuel is vaporized. As a result, gas fuel is generated in the sub fuel tank 11, and stored as gas-liquid mixed fuel together with liquid fuel.

A negative pressure is generated on the suction side of the primary pump 8, and hence, the gas-liquid mixed fuel in the sub fuel tank 11 is returned from the orifice 35 through the return pipeline 34 to the suction side of the primary pump 8. Then, a discharge pressure of the primary pump 8 and additionally a fuel pressure in the low pressure pipeline 10 are kept at the set pressure of the relief valve 37 by a pressure adjustment function of the relief valve 37. Consequently, when flowing through the low pressure pipeline 10, the fuel is preloaded at the set pressure of the relief valve 37, for example, about 120 kPa to facilitate liquefying. Therefore, impact of environmental disturbances as factors that fluctuate a gas-liquid mixture ratio is reduced, and most of the gas fuel in the fuel is liquefied. Furthermore, the gas-liquid mixture ratio of the fuel is kept almost constant due to increase in ratio of the liquid fuel. Such fuel circulating through a circulation path formed between the primary pump 8 and the sub fuel tank 11 by the low pressure pipeline 10 and the return pipeline 34 is sequentially suctioned in accordance with an operation of the secondary pump 12.

The one end of the return pipeline 34 is connected to the upper part of the sub fuel tank 11 as a measure for a purpose of efficiently liquefying the gas fuel. That is, the gas fuel stays in the upper part of the sub fuel tank 11, and hence, the fuel containing much gas fuel is returned through the return pipeline 34 connected to the upper part to a primary pump 8 side. Consequently, the gas fuel can be more efficiently liquefied by preloading in the low pressure pipeline 10, and the ratio of the liquid fuel to be contained in the fuel can further increase.

Then, the fuel circulating through the circulation path in this manner, that is, the fuel preloaded in the low pressure pipeline 10 to have a high ratio of the liquid fuel and kept at an almost constant gas-liquid mixture ratio is continuously supplied to the secondary pump 12. Therefore, redundant description is not made. In the same manner as in the first embodiment, the gas-liquid mixture ratio of the fuel to be supplied to the secondary pump 12 is kept almost constant, the discharge pressure of the pump is stabilized and fuel pressure controllability can improve. Furthermore, since the ratio of the liquid fuel in the fuel to be supplied to the secondary pump 12 is high, the secondary pump 12 can be operated with low load and constant load and pump efficiency can improve.

Aspects of the present invention are not limited to these embodiments. For example, in the above embodiments, the invention is embodied in the fuel supply device 4, 31 of the engine 3 mounted in the outboard machine 1 of the ship 2, but a targeted engine is not limited to this engine. For example, the invention may be embodied in a fuel supply device of a targeted engine mounted not in the outboard machine 1, but mounted as a power source in the ship 2 itself.

Further, in the above first embodiment, the relief valve 19 is provided between the sub fuel tank 11 and the return pipeline 21 and the interior of the sub fuel tank 11 is preloaded, while in the second embodiment, the relief valve 37 is interposed in the relief pipeline 36 connecting the low pressure pipeline 10 and the return pipeline 34 and the low pressure pipeline 10 is preloaded. However, there are not any special restrictions on a position where each relief valve 19, 37 is placed as long as the fuel circulating through the circulation path can be preloaded. For example, in FIG. 1, the relief valve 19 may be provided in a connected portion between the supply pipeline 7 and the return pipeline 21.

REFERENCE SIGNS LIST

4, 31 fuel supply device
5 main fuel tank (a fuel supply source)
8 primary pump
10 low pressure pipeline (a first pipeline)
11 sub fuel tank (a tank)
12 secondary pump

13 orifice (an outflow part)
15 high pressure pipeline (a second pipeline)
19, 37 relief valve (a preloading part, a pressure adjustment valve)
21, 34 return pipeline (a third pipeline)
33 regulator valve (an outflow part, a pressure adjustment valve)
36 relief pipeline (a fourth pipeline)

What is claimed is:

1. A fuel supply device of an engine, comprising:

a primary pump suctioning fuel supplied from a fuel supply source to discharge the fuel to a first pipeline, a secondary pump connected in series to the primary pump via the first pipeline, and suctioning the fuel supplied from the primary pump through the first pipeline to supply the fuel through a second pipeline to an engine side, a tank storing the fuel, and accommodating the secondary pump inside, an outflow part causing part of the fuel flowing from the first pipeline through the secondary pump to the second pipeline in the tank to flow out into the tank, a third pipeline connecting an interior of the tank and a suction side of the primary pump, and returning, to the suction side of the primary pump, gas-liquid mixed fuel generated in the tank by vaporizing the fuel flowing out from the outflow part, and a preloading part provided in one of portions of a circulation path formed between the primary pump and the tank by the first pipeline and the third pipeline, and preloading the fuel circulating through the circulation path.

2. The fuel supply device of the engine according to claim 1, wherein the preloading part is a pressure adjustment valve provided in the third pipeline.

3. The fuel supply device of the engine according to claim 2, wherein the outflow part is an orifice provided in the first pipeline in the tank, and causing part of the fuel flowing through the first pipeline to flow out into the tank while restricting the part of the fuel.

4. The fuel supply device of the engine according to claim 1, wherein the preloading part is a pressure adjustment valve interposed in a fourth pipeline connecting the first pipeline and the third pipeline.

5. The fuel supply device of the engine according to claim 4, wherein the outflow part is a pressure adjustment valve connected to the second pipeline in the tank, opening and closing based on a set pressure to adjust a discharge pressure of the secondary pump, and causing the fuel discharged from the secondary pump when the valve is opened to flow out into the tank.

6. The fuel supply device of the engine according to claim 5, wherein the third pipeline connects an upper part of the interior of the tank and the suction side of the primary pump.

7. The fuel supply device of the engine according to claim 4, wherein the third pipeline connects an upper part of the interior of the tank and the suction side of the primary pump.

* * * * *